United States Patent [19]

Edwards

[11] 4,010,566

[45] Mar. 8, 1977

[54] THUMB TRIGGER AND AUTOMATIC SAFETY

[76] Inventor: Walter William Edwards, Rte. 1 Box 265, Bruno, Minn. 55712

[22] Filed: Mar. 19, 1975

[21] Appl. No.: 559,672

[52] U.S. Cl. ..... 42/69 R; 42/41

[51] Int. Cl.[2] ..... F41C 19/00

[58] Field of Search ..... 42/69 R, 69 A, 69 B, 42/41

[56] References Cited

UNITED STATES PATENTS

| | | | |
|---|---|---|---|
| 1,230,973 | 6/1917 | Yeaton | 42/69 R |
| 1,395,903 | 11/1921 | Buhl | 42/41 |
| 3,210,879 | 10/1965 | La Rue | 42/69 R |

FOREIGN PATENTS OR APPLICATIONS

| | | | |
|---|---|---|---|
| 434,675 | 12/1911 | France | 42/41 |

*Primary Examiner*—Charles T. Jordon

[57] ABSTRACT

A thumb trigger and automatic safety are provided for firearms. The automatic safety may be adapted to the gun or stock and is operable by spring loaded means provided on an upper portion of the firearm. Operation of the spring loaded safety and push button is by pressure from the thumb.

8 Claims, 5 Drawing Figures

THUMB TRIGGER AND AUTOMATIC SAFETY

BACKGROUND OF THE INVENTION

Since potential human error and other difficulties in manually precisely positioning the firearm sights when pulling the trigger during firing affects accuracy, a thumb trigger is proposed to insure uniform accuracy of position on the target.

The device is suitable for application to all firearms, and has an automatic safety that is released during the act of firing and which is returned to a locked position when the thumb trigger is released.

SUMMARY OF THE INVENTION

The primary object of the invention is to provide a thumb trigger which may be applied readily and inexpensively to all firearms. It will be more accurate than a finger trigger on firearms. It will be safer since a person can control his thumb better than his finger, and can see his thumb better on the thumb button than he can see his finger on a finger trigger.

Another object of the invention is to be able to line up the target faster, and more accurately, than with the old mechanism of a finger trigger.

Another object is to provide a push button mechanism having good construction, low cost, and being compact and light in weight.

Another object is that it will be less tiresome to push on a button with the thumb than to manually tug on a finger trigger.

Another object is that a person won't have an intermittent jiggling motion associated with the finger trying to find the trigger.

Another object of the invention is the spring loaded safety, the safety automatically goes on when a person moves his thumb off the thumb trigger, so there is no danger of the cartridge being struck by the firing pin and a person doesn't have to remember to put the safety on, since as the push button returns to its normal position the spring loaded safety returns back to its normal position.

BRIEF DESCRIPTION OF THE DRAWINGS

The invention will further be described with reference to thhe accompanying drawings wherein like numbers refer to like parts in the several views and wherein.

Before explaining the present invention in detail, it is to be understood that the invention is not limited in its application to the details of construction and arrangement of parts illustrated in the accompanying drawings, since the invention is capable of being installed in all new firearms and older models with a little modification, and other embodiments practiced or carried out in various ways. Also, it is to be understood that the phraseology or terminology employed herein is for the purpose of description and not of limitation. The scope of the invention being defined in the claims.

DESCRIPTION OF THE PREFERRED EMBODIMENTS

Figure 1:
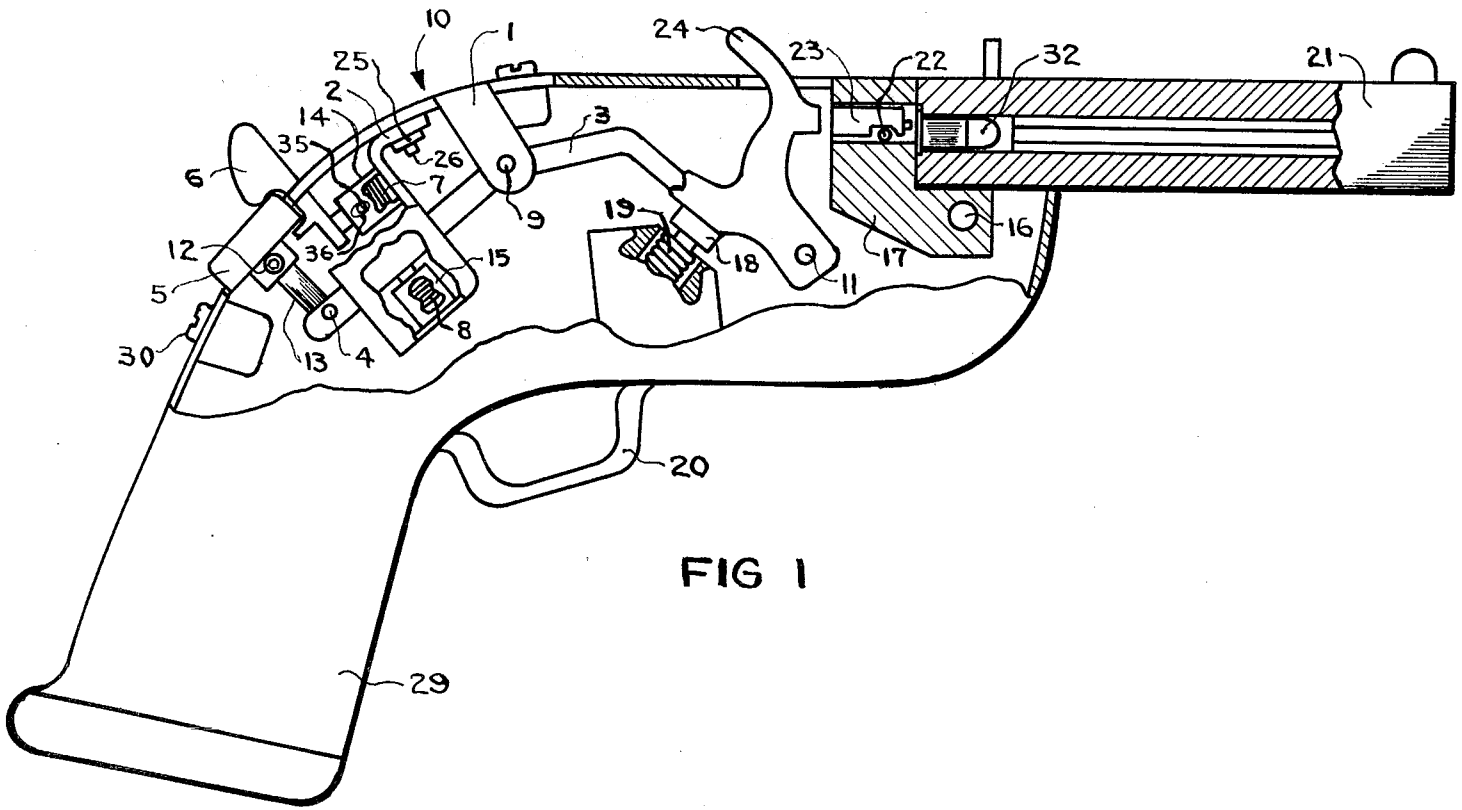
FIG. 1 is a horizontal plan view of a pistol according to the invention with parts broken away to show details of the thumb trigger.
Figure 2:
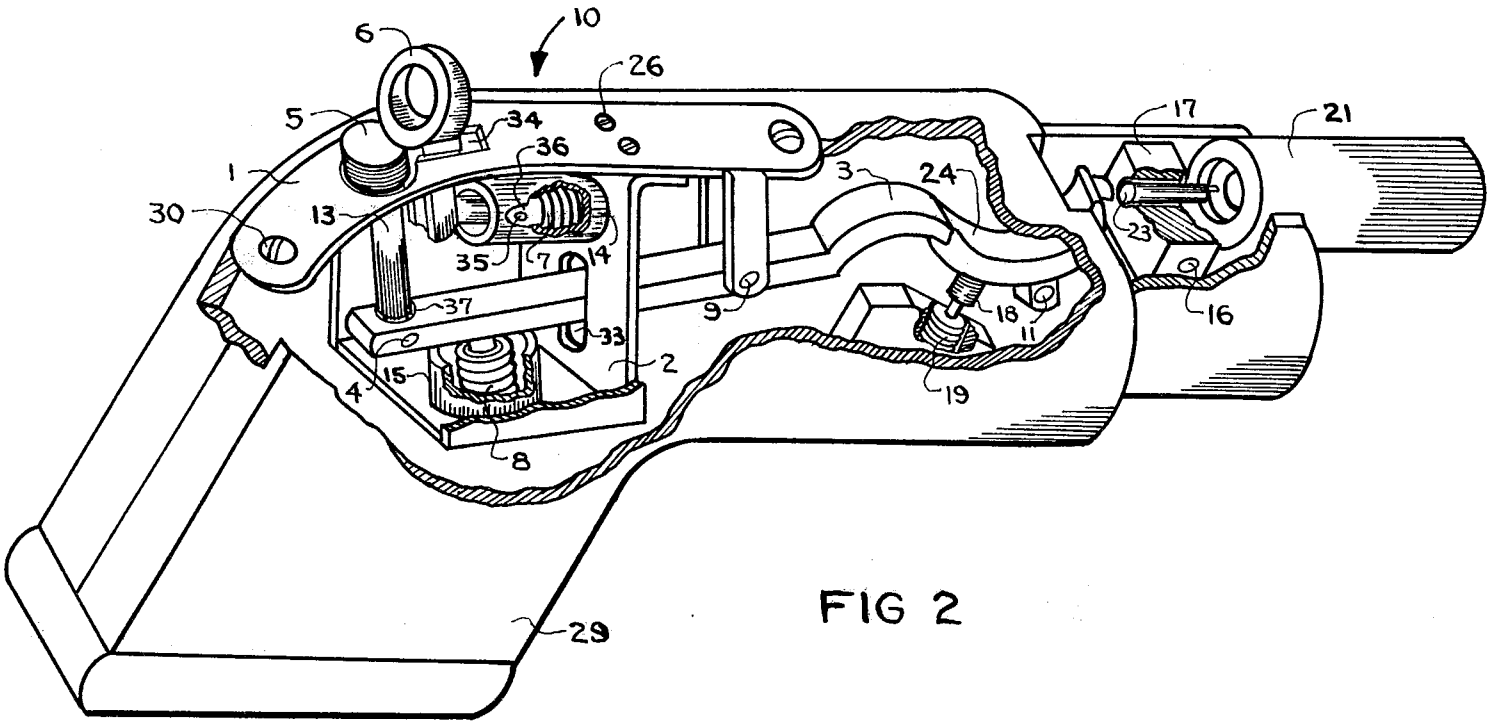
FIG. 2 is a perspective view of the pistol of FIG. 1.

Referring now to FIGS. 1 and 2, there is shown a device according to the present invention and generally designated by the numeral 10. The device 10 is useful on all firearms to increase the accuracy thereof in hitting a target. The device 10 includes a partially enclosed casing 1, and a bracket 2, to provide a holder for trigger spring 8 and safety spring 7. Bracket 2 has two pem nuts 25 pressed therein so that bracket 2 can be assembled to casing 1 with screws 26. The casing 1 can be installed in all firearms with screws 30. An arm 3, mounted for relative movement between tabs on casing 1, is pivotably attached via a pivot pin 9, press fitted into the tabs on casing 1. Arm 3 has a clearance hole therein for pivot pin 9 and the pivot point is located near the center of the device 10. A trigger spring 8 is mounted in a tube 15 and a boss on arm 3 extends into spring 8 so that the spring 8 is perpendicular to arm 3 and secured in place by the boss thereon. A push botton 5 is mounted on one end of a shaft 13 by means of a set screw 12. The other end of the shaft 13 is received in a groove at the end of arm 3. The shaft 13 has a clearance hole for receiving a pin shaft 4, press fitted into arm 3, when shaft 13 is inserted perpendicularly into the groove in arm 3 to secure shaft 13 to arm 3. A hammer 24 is pivotably mounted on a hammer pin 11 and is spring loaded by a main spring 19 and main spring plunger 18. A firing pin 23 and firing pin retainer 22 are mounted in a breechblock 17 which is mounted to pistol stock 29 by breechblock pin 16.

As shown in FIGS. 1 and 2, when push button 5 is pressed, shaft 13 will engage arm 3 and arm 3 will release hammer 24 which strikes firing pin 23 which in turn strikes cartridge 32 in barrel 21, thus firing the cartridge.

The casing 1 is provided with a horizontal slot 34 for mounting a safety 6 for movement therein. The safety 6 has a boss with a hole therein for receiving a pin 35 press fitted therein. A safty spring 7 is inserted in a tube 14 and the safety 6 is then inserted into tube 14 in alignment with slot 34. The safety 6 has a lip on a lower portion for engaging the push button 5 and preventing its actuation. The safety 6 is normally biased into engagement with the push button 5 and must be moved forward against the biasing of spring 7 before the push button 5 can be actuated.

Figure 3:
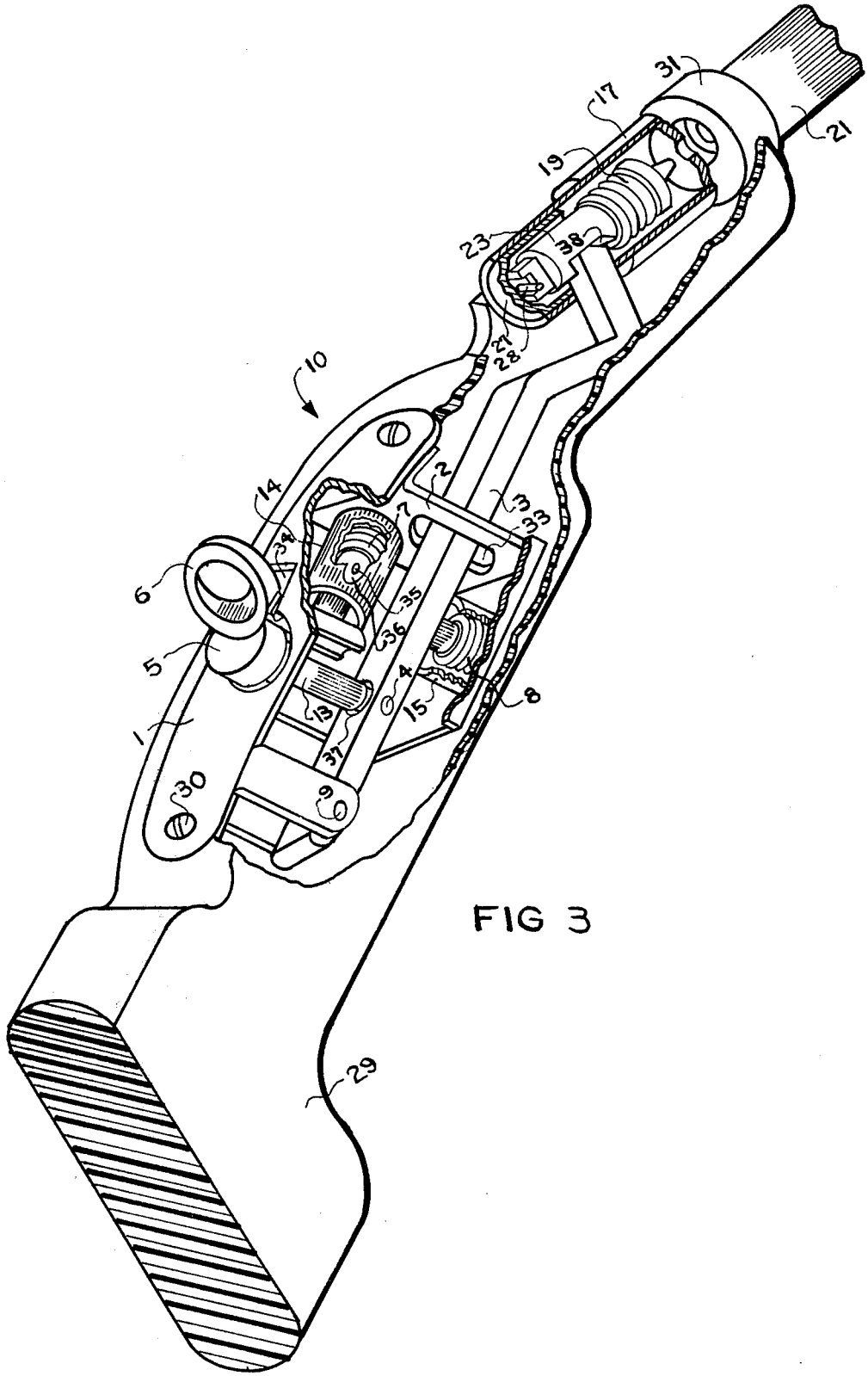
FIG. 3 is a perspective view of a gun, with parts broken away to show details of the thumb trigger.

The device shown in FIG. 3 is similar to the device shown in FIGS. 1 and 2, but is adapted to guns other than pistols. In FIG. 3 the device 10 is mounted in the gun by two screws 30. The arm 3 is mounted between tabs on casing 1 with its pivot point toward the rear end of the casing 1. The arm 3 has a clearance hole therein and is pivotably attached via a pivot pin 9. The pivot pin 9 is press fitted into the tabs on casing 1. The device 10 is assembled by inserting spring 8 in tube 15, sliding arm 3 through vertical slot 33 in bracket 2, inserting the boss on arm 3 into spring 8, and press fitting pivot pin 9 into the tabs in casing 1. The safety 6 is mounted for movement in a horizontal slot 34 in casing 1 and has a lip engaging the underside of push button 5. The safety 6 is assembled by sliding the safety up through the hole for the push button 5, safety spring 7 is inserted into tube 14, boss on safety 6 is inserted into tube 14, and a pin shaft 35 is press fitted into the boss on safety 6. The pin shaft 35 should be long enough to stick out on both sides of the boss in order to be flush on both sides of tube 14. The shaft 13 is mounted for movement in a slot 37 in arm 3. Shaft 13 has a clearance hole for receiving a pin shaft 4 press fitted therein so that shaft 13 can pivot a small amount relative to arm 3. The push button 5 has a hole for receiving the shaft 13 therein, the shaft being held in the push button hole by a set screw 12. In order to install shaft 13 and push button 5, spring 7, safety 6, and pin shaft 35 have to be in their right positions before shaft 13, push button 5, and set screw 12 can be installed.

The device 10 is mounted into the gun as shown in FIG. 3. The arm 3 has one end inserted into a slot 38 in the firing pin 23 which is mounted in breechblock 17 which also contains a main spring retainer cap 27 and retainer cap pin 28. A receiver 31 at the end of the breechblock 17 receives a barrel 21. The device 10 can be installed in the upper end of stock 29 by two screws 30, and a finger support 20 (as shown in FIG. 1) can be mounted on the underside of stock 29 below device 10.

Figure 4:
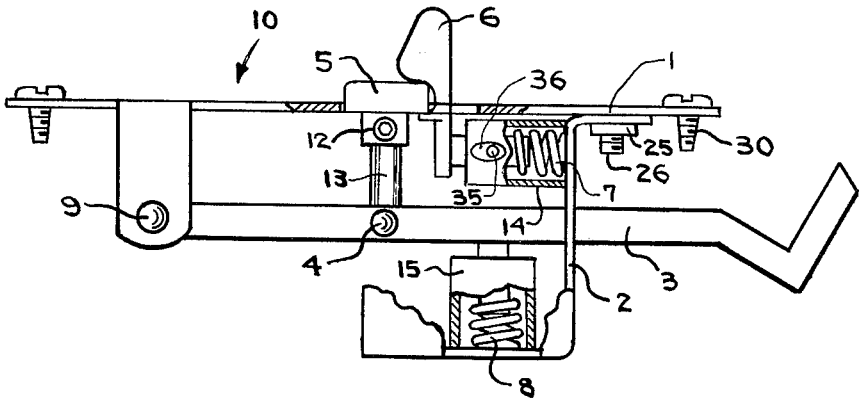
FIG. 4 is a horizontal plan view of the thumb trigger mechanism.
Figure 5:
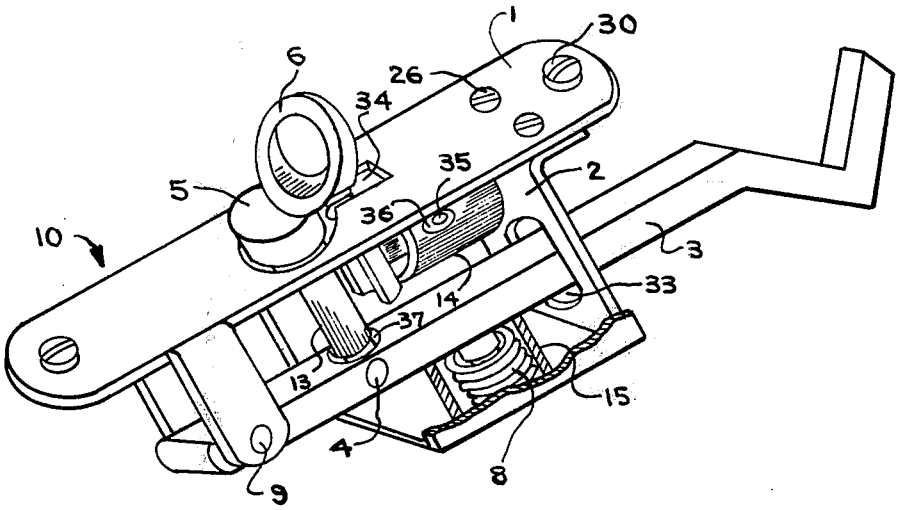
FIG. 5 is a perspective view of the thumb trigger mechanism.

FIGS. 4 and 5 show the device 10 disassembled from the gun.

My thumb trigger has a very neat appearance, all the moving parts are contained in one casing 1, and may be preassembled and easily installed in all firearms with only two screws 30. The thumb trigger may be used in any position, and in any kind of weather, since a person can push the thumb trigger even with mittens on to protect his hands from freezing.

I claim:

1. A thumb trigger and automatic safety comprising: a casing having two tabs for locating a pivot point thereon, a swinging arm pivoted about a pivot pin and secured thereby between said tabs, said arm having a clearance hole at said pivot point for receiving said pivot pin therein, said arm having a slot therein for receiving a perpendicular shaft, said arm having a hole therein for receiving a press fitted pin, said arm having a boss extending downwardly therefrom into a vertically oriented cylindrical tube containing a compression spring, said arm extending through a slot in a partially enclosed bracket mounted on said casing, said arm having an angled bend at one end thereof for engaging a firing striker, and means for mounting said casing in a firearm for actuation by a thumb trigger.

2. A thumb trigger and safety according to claim 1, wherein said boss engages said compression spring, and said spring biases said arm to its normal position.

3. A thumb trigger and safety according to claim 1, wherein said tabs are located at the rear end of said casing, said tabs have aligned holes therein for alignment with said clearance hole in said arm, said pivot pin is press fitted into said holes in said tabs, and said arm is movable from its normal position when said thumb trigger is actuated.

4. A thumb trigger and safety according to claim 1, wherein said tabs are located near a center portion of said casing, said tabs have aligned holes therein for alignment with said clearance hole in said arm, said pivot pin is press fitted in said holes in said tabs, and said arm is movable from its normal position when said thumb trigger is actuated.

5. A thumb trigger and safety according to claim 1, wherein said shaft has a clearance hole therein, said shaft is mounted in the slot in said arm by said press fitted pin extending through said hole in said arm and said shaft clearance hole, and said shaft is actuated by a thumb trigger button.

6. A thumb trigger and safety according to claim 5, wherein said thumb trigger button has a bore therein for receiving one end of said shaft, and said button has a set screw for securing said button to said shaft.

7. A thumb trigger and safety according to claim 1, wherein said automatic safety comprises: a safety mounted on an upper portion of said bracket, said safety having a cylindrical boss extending therefrom, said safety boss having a hole therein for receiving a press fitted mounting pin having ends thereof extending out both sides of said safety boss, a horizontally oriented cylindrical tube having two slots therein, a compression spring in said horizontal tube for engaging said safety boss and biasing the safety to a safe position, said safety boss extending into said horizontal tube and mounted therein with the ends of said mounting pin engaging said tube slots, and means for mounting said safety on said casing for actuation by the thumb.

8. A thumb trigger and safety according to claim 7, wherein said safety has a lip on a lower portion thereof for engagement with a thumb trigger push button for blocking actuation thereof until said safety has been moved against the bias of said safety compression spring.

* * * * *